US008655225B2

(12) United States Patent
Ohnishi

(10) Patent No.: US 8,655,225 B2
(45) Date of Patent: Feb. 18, 2014

(54) PROCESSING ASSEMBLY, FIXING DEVICE AND IMAGE FORMING APPARATUS WITH FIXING DEVICE

(75) Inventor: Yuzo Ohnishi, Osaka (JP)

(73) Assignee: Kyocera Mita Corporation (JP)

( * ) Notice: Subject to any disclaimer, the term of this patent is extended or adjusted under 35 U.S.C. 154(b) by 481 days.

(21) Appl. No.: 13/008,931

(22) Filed: Jan. 19, 2011

(65) Prior Publication Data

US 2011/0182031 A1 Jul. 28, 2011

(30) Foreign Application Priority Data

Jan. 26, 2010 (JP) ..... 2010-014626

(51) Int. Cl.
*G03G 15/16* (2006.01)

(52) U.S. Cl.
USPC ..... 399/122; 399/107

(58) Field of Classification Search
USPC ..... 399/107, 122
See application file for complete search history.

(56) References Cited

U.S. PATENT DOCUMENTS 5,579,098 A 11/1996 Noguchi et al.
6,314,256 B1 * 11/2001 Saitoh ..... 399/122

FOREIGN PATENT DOCUMENTS

| | | |
|---|---|---|
| JP | 3-80460 | 8/1991 |
| JP | 7-210023 | 8/1995 |
| JP | 2000-356938 | 12/2000 |
| JP | 2004189426 | 7/2004 |
| JP | 200953563 | 3/2009 |

* cited by examiner

*Primary Examiner* — Hoang Ngo
(74) *Attorney, Agent, or Firm* — Geral E. Hespos; Michael J. Porco; Matthew T. Hespos

(57) ABSTRACT

A processing assembly includes: a processing housing configured to support a processor for executing a given process; an immobilizing mechanism configured to immobilize the processing housing and including an operation portion configured to release the immobilized processing housing; a cover mounted on the processing housing so as to be rotatable between a first position where the operation portion is covered by the cover and a second position where the operation portion is exposed to be visible; and a knob rotatably mounted on the processing housing and configured to rotate integrally with the cover.

8 Claims, 8 Drawing Sheets

PROCESSING ASSEMBLY, FIXING DEVICE AND IMAGE FORMING APPARATUS WITH FIXING DEVICE

BACKGROUND OF THE INVENTION

1. Field of the Invention

This invention relates to a processing assembly for performing a given process, a fixing device for fixing toner on a sheet, and an image forming apparatus.

2. Description of the Related Art

Mechanical equipment often allows a component or a portion of the equipment to be removed for maintenance and inspection. For example, photocopiers, printers, fax machines, and other image forming apparatuses are exemplified as such equipment.

An image forming apparatus typically comprises a fixing device configured to fuse and fix toner to a sheet. The fixing device comprises an immobilizing mechanism configured to immobilize a position of the fixing device in a housing of the image forming apparatus. A user may operate the immobilizing mechanism to unlock and then remove the fixing device to outside of the housing of the image forming apparatus.

As described above, the fixing device generates heat in order to fuse toner. A particular fixing device has a color changing portion configured to change color according to the heat from the fixing device, in order to secure safety for a user. The user may visually recognize temperature of the fixing device, and more safely replace the fixing device.

In general, unnecessary operation on mechanical equipment is undesirable. For example, when the immobilizing mechanism of the fixing device is unnecessarily or unintentionally operated, the immobilized position of the fixing device may be released, which results in unintended movement of the fixing device. This may detract usual functions of the fixing device.

The above-described fixing device with the color changing portion may give a user some caution. However, when the user does not notice a change in color of the color changing portion, or does not recognize the meaning of the color change, the caution by the color change is not effective.

SUMMARY OF THE INVENTION

The object of the present invention is to provide a processing assembly, a fixing device and an image forming apparatus which is less likely to cause unnecessary operation by a user.

A processing assembly including a processor configured to execute a given process according to one aspect of the invention includes: a processing housing configured to support the processor; an immobilizing mechanism configured to immobilize a position of the processing housing, and including an operation portion configured to release the immobilized processing housing; a cover mounted on the processing housing so as to be rotatable between a first position where the operation portion is covered by the cover and a second position where the operation portion is exposed to be visible; and a knob rotatably mounted on the processing housing and configured to rotate integrally with the cover.

A fixing device including a fixing portion configured to fuse and fix toner to a sheet according to another aspect of the invention includes: a fixing housing configured to support the fixing portion; an immobilizing mechanism configured to immobilize a position of the fixing housing, and including an operation portion configured to release the immobilized fixing housing; a cover mounted on the fixing housing so as to be rotatable between a first position where the operation portion is covered by the cover and a second position where the operation portion is exposed to be visible; and a knob rotatably mounted on the fixing housing and configured to rotate integrally with the cover.

An image forming apparatus for forming an image on a sheet according to yet another aspect of the invention includes: a housing; an image forming unit configured to form the image on the sheet with toner; a fixing housing configured to support a fixing portion for fusing and fixing the toner on the sheet; an immobilizing mechanism configured to immobilize a position of the fixing housing in the housing, and including an operation portion configured to release the immobilized fixing housing; a cover mounted on the fixing housing so as to be rotatable between a first position where the operation portion is covered by the cover and a second position where the operation portion is exposed to be visible; and a knob rotatably mounted on the fixing housing and configured to rotate integrally with the cover.

DETAILED DESCRIPTION OF THE PREFERRED EMBODIMENTS

Below, a processing assembly, a fixing device and an image forming apparatus according to one embodiment are described referring to the accompanying drawings. Directional terms such as "upward", "downward", "left" and "right" hereinafter are simply used for the purpose of clarifying the description, and in no way limit principles of the processing assemblies, fixing devices or image forming apparatuses. Further, a term "sheet" used in the following description means a photocopier sheet, tracing paper, thick paper, an overhead projector sheet or another sheet on which an image may be formed or another arbitrary sheet material on which a given process is performed. A term "process" used in the following description means an arbitrary process in which a material is modified to change its properties.

Figure 1:
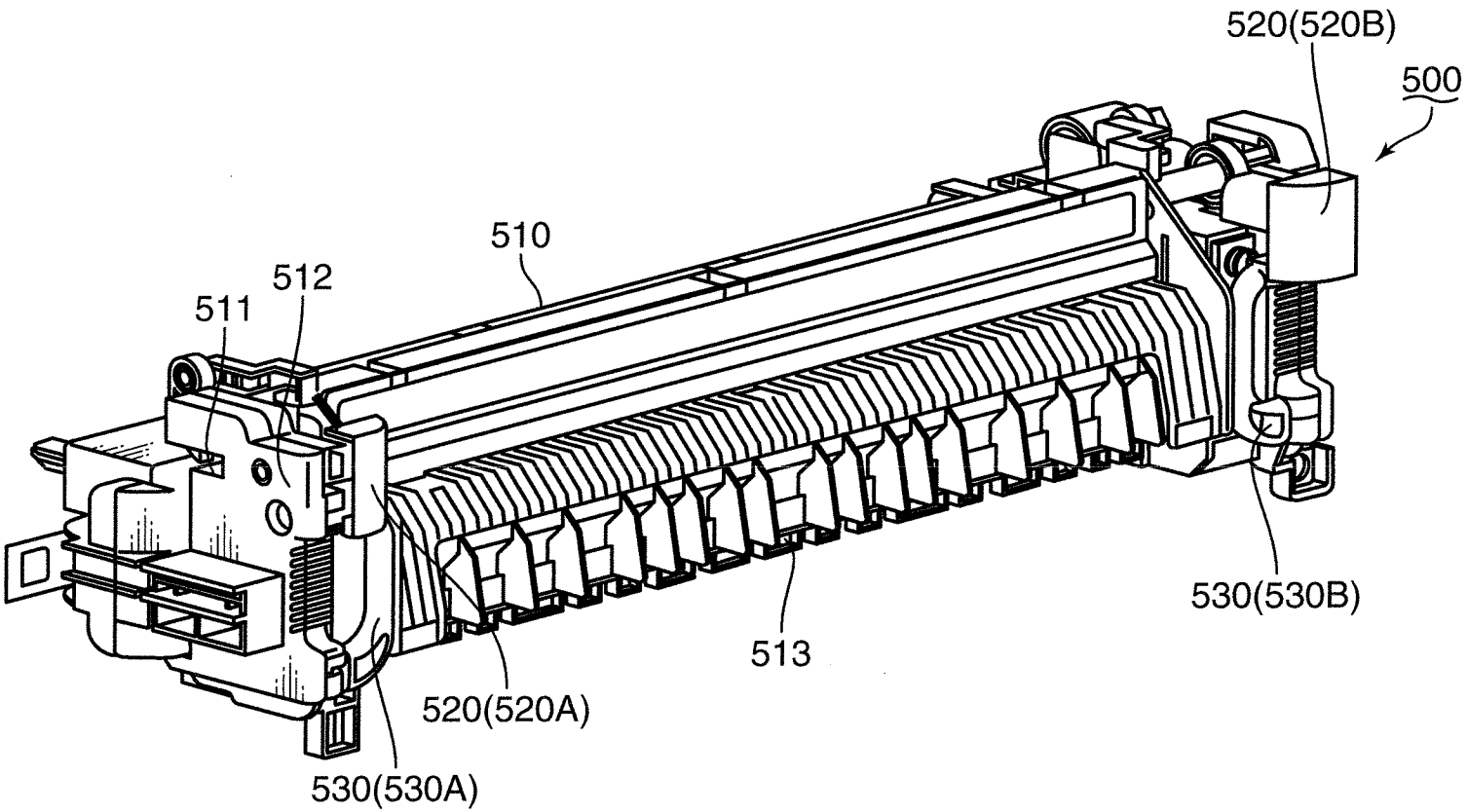
FIG. 1 is a perspective view of a fixing device according to one embodiment.

FIG. 1 is a perspective view of a processing assembly according to one embodiment. The processing assembly shown in FIG. 1 is a fixing device used in image forming apparatuses such as photocopiers, printers and fax machines, and executes a fixing process in which toner is fused and fixed onto a sheet. Alternatively, an arbitrary device configured to execute some other processes may be used as a processing assembly.

The fixing device 500 includes a fixing housing 510 in which a roller pair configured to nip and convey a sheet, a heater configured to give thermal energy to the roller pair, wiring to supply electric power to the heater and other equipment necessary to execute the fixing process, for example, are accommodated and supported. In this embodiment, the fixing housing 510 is exemplified as a processing housing. In another embodiment using the processing assembly configured to perform a given process other than fixing processing, the processing housing may accommodate and support equipment necessary for an arbitrary process executed by the processing assembly.

The fixing device 510 comprises a side plate 512 in which a horizontally extending slit 511 is formed. A support plate to support the fixing housing 510 is inserted into the slit 511. In this embodiment, an inner wall of the housing of the image forming apparatus is used as the support plate.

The fixing device 500 comprises a substantially fan-shaped columnar cover 520 rotatably mounted on the fixing housing 510 and a knob 530, which looks like a substantially C-shaped rod, formed integrally with the cover 520. The knob 530 extends downward from the cover 520. A user may grip the knob 530 to integrally rotate the knob 530 and the cover 520 between a first position where the knob 530 lies along a front plate 513 of the fixing housing 510 and a second position where the knob 530 protrudes to the front side with respect to the front plate 513. In this embodiment, when the knob 530 and the cover 520 are moved to the second position, the user may grip the knob 530 and apply force to the fixing device 500 so that the fixing housing 510 moves along the slit 511.

Figure 2:
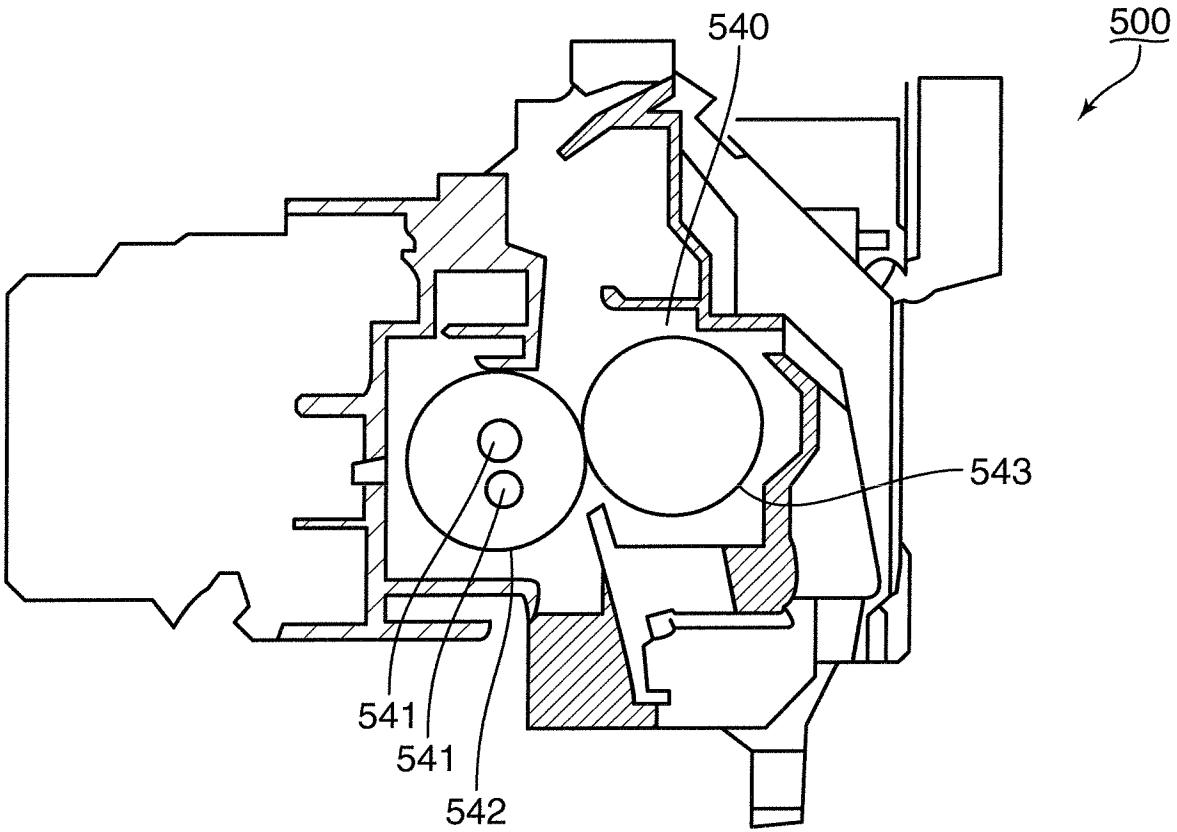
FIG. 2 is a schematic cross-sectional view of the fixing device shown in FIG. 1.

FIG. 2 is a schematic cross-sectional view of the fixing device 500 shown in FIG. 1. The fixing device 500 is further described with FIGS. 1 and 2.

The fixing device 500 comprises a fixing portion 540 used as a processor. The fixing portion 540 applies pressure to a sheet while fusing the toner, which is therefore fixed on the sheet. The fixing portion 540 comprises a heating roller 542 incorporating a heater 541, and a pressing roller 543 in pressing contact with the heating roller 542. The toner receiving the heat energy from the heater 541 is fixed onto the sheet while the sheet bearing the toner passes between the heating roller 542 and the pressing roller 543.

The fixing housing 510 supports the fixing portion 540. The fixing housing 510 may become considerably heated due to radiation heat or conduction heat from the heating roller 542.

Figure 3:
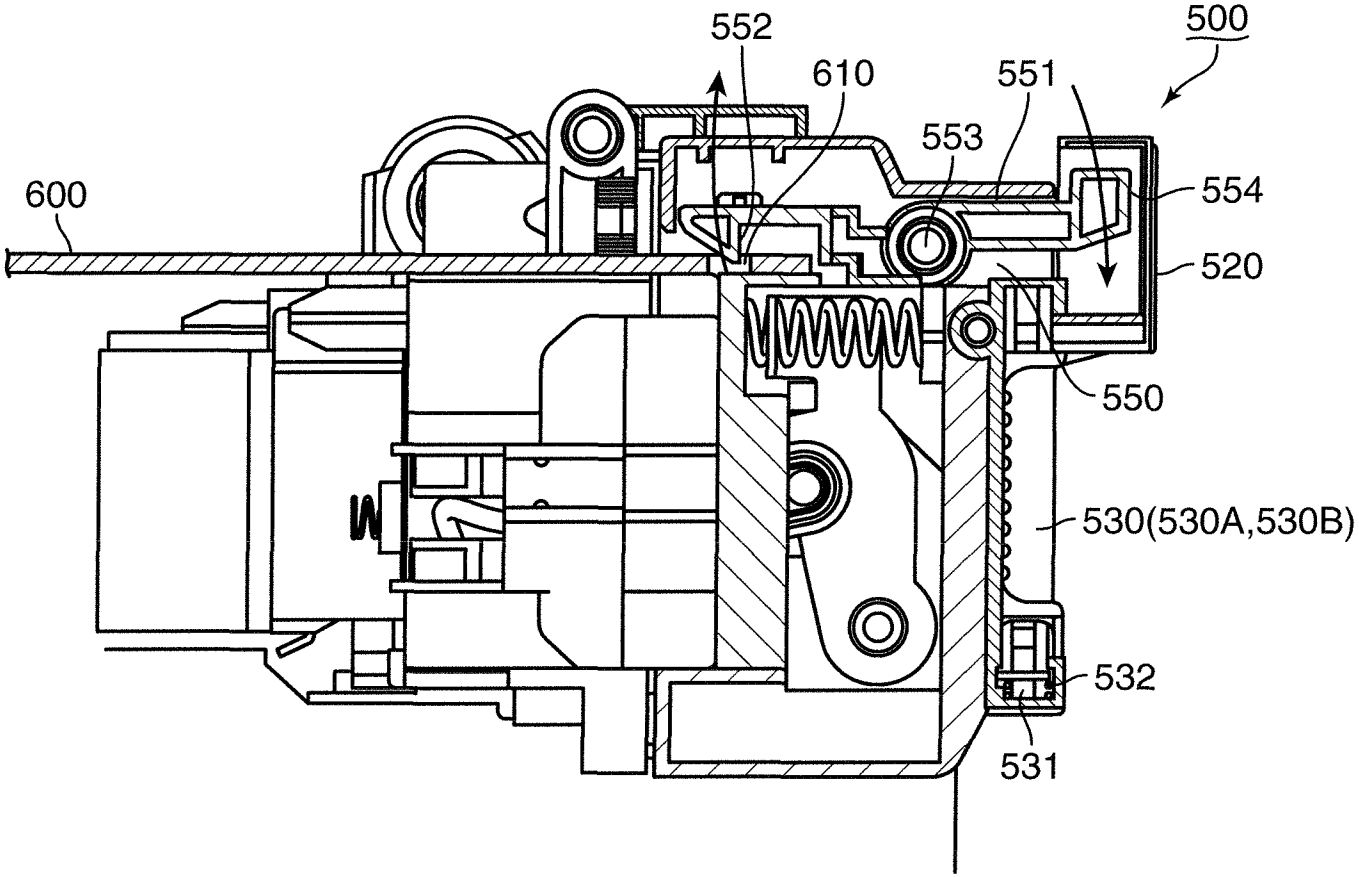
FIG. 3 is a schematic cross-sectional view of the fixing device shown in FIG. 1.

FIG. 3 is a schematic cross-sectional view of the fixing device 500 shown in FIG. 1. The fixing device 500 is further described with FIGS. 1 and 3.

As described above, the fixing device 500 is accommodated in the housing of the image forming apparatus. A support plate 600 as a support portion to stably support the fixing device 500 is formed in the housing of the image forming apparatus. The support plate 600 is inserted into the slit 511 formed in the side plate 512 of the fixing housing 510, as described above. An engaging hole 610 to immobilize a position of the fixing device 500 is formed in the support plate 600.

The fixing device 500 comprises an immobilizing mechanism 550 for engaging with the engaging hole 610 to immobilize the position of the fixing housing 510 at the support plate 600. The immobilizing mechanism 550 comprises a substantially rectangular column-shaped arm 551, a substantially triangular columnar hook 552 protruding from a lower surface of a tip of the arm 551, and a rotating shaft 553 provided at substantially a middle position in a longitudinal direction of the arm 551. The rotating shaft 553 rotatably supports the arm 551 relative to the fixing housing 510. The arm 551 may rotate about the rotating shaft 553. The fixing device 500 comprises, as a first biasing member, a torsion coil spring (not shown) wound around the rotating shaft 553. The torsion coil spring is connected to the arm 551 and the rotating shaft 553 so as to bias the arm 551 in a direction where the hook 552 engages the engaging hole 610.

A substantially rectangular parallelepiped operation portion 554 is formed at a base portion of the arm 551. The operation portion 554 is used to release the immobilized fixing housing 510 from the support plate 600 by the immobilizing mechanism 550. When a user presses the operation portion 554 downward, the arm 551 rotates about the rotating shaft 553 between the hook 552 and the operation portion 554. Consequently the hook 552 moves upward so that the hook 552 is disengaged from the engaging hole 610.

Figure 4:
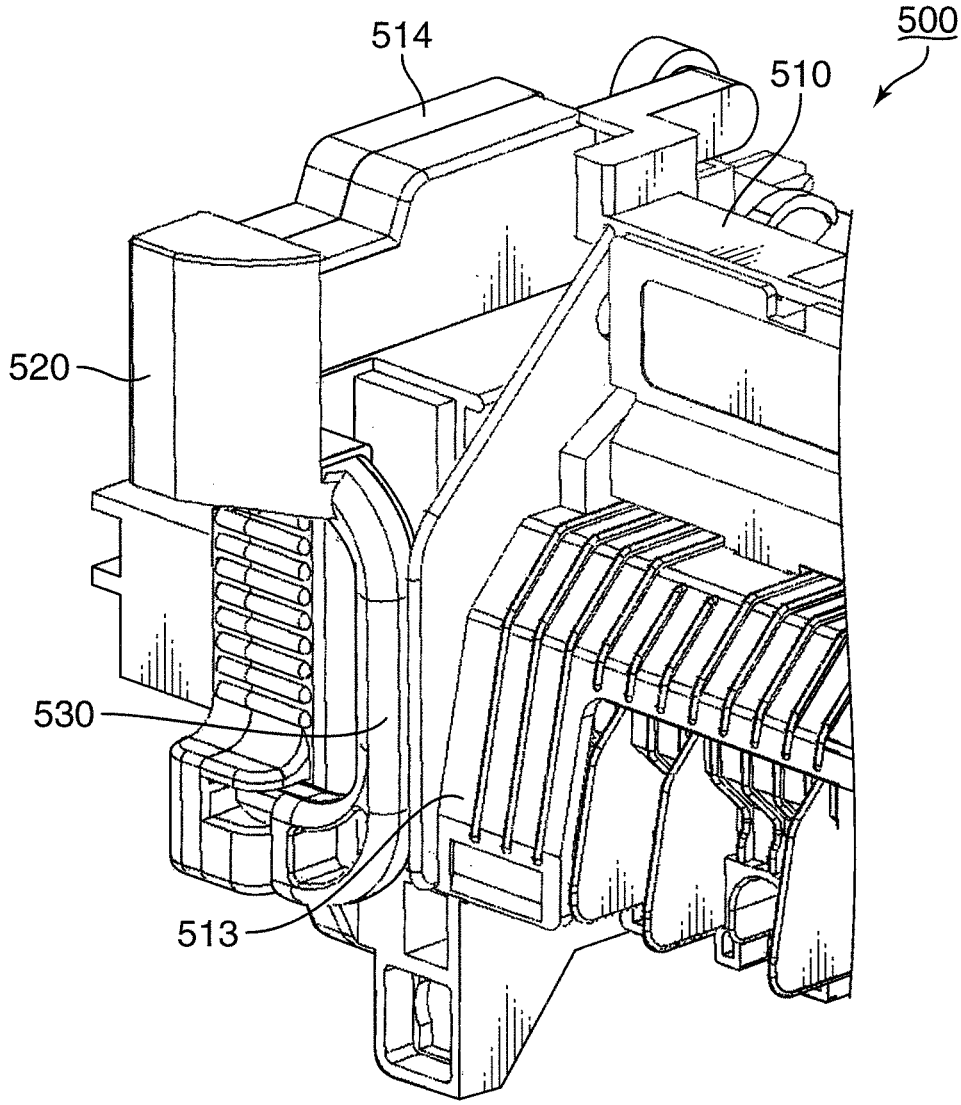
FIG. 4 is an enlarged view around a cover and a knob of the fixing device shown in FIG. 1.

FIG. 4 is an enlarged perspective view of the fixing device 500 and shows a structure around the cover 520 and knob 530. The fixing device 500 is further described with FIGS. 1, 3 and 4.

The fixing housing 510 comprises an accommodating portion 514 to accommodate the immobilizing mechanism 550 described in the context of FIG. 3. The operation portion 554 is exposed from an end surface of the accommodating portion 514.

The cover 520 surrounds the operation portion 554 which is exposed from the end surface of the accommodating portion 514. The cover 520 may be, for example, formed from opaque resin (preferably resin of the same color as the fixing housing 510). Consequently the cover 520 invisibly covers the operation portion 554. Alternatively, cover 520 formed using transparent resin may surround the operation portion 554. By means of such a structure, the user may be less likely to touch the operation portion 554. In this embodiment, as shown in FIG. 4, the position of the cover 520 for invisibly covering the operation portion 554 is exemplified as a first position. When the cover 520 is in the first position, the knob 530 is positioned along the front plate 513 of the fixing housing 510.

Figure 5:
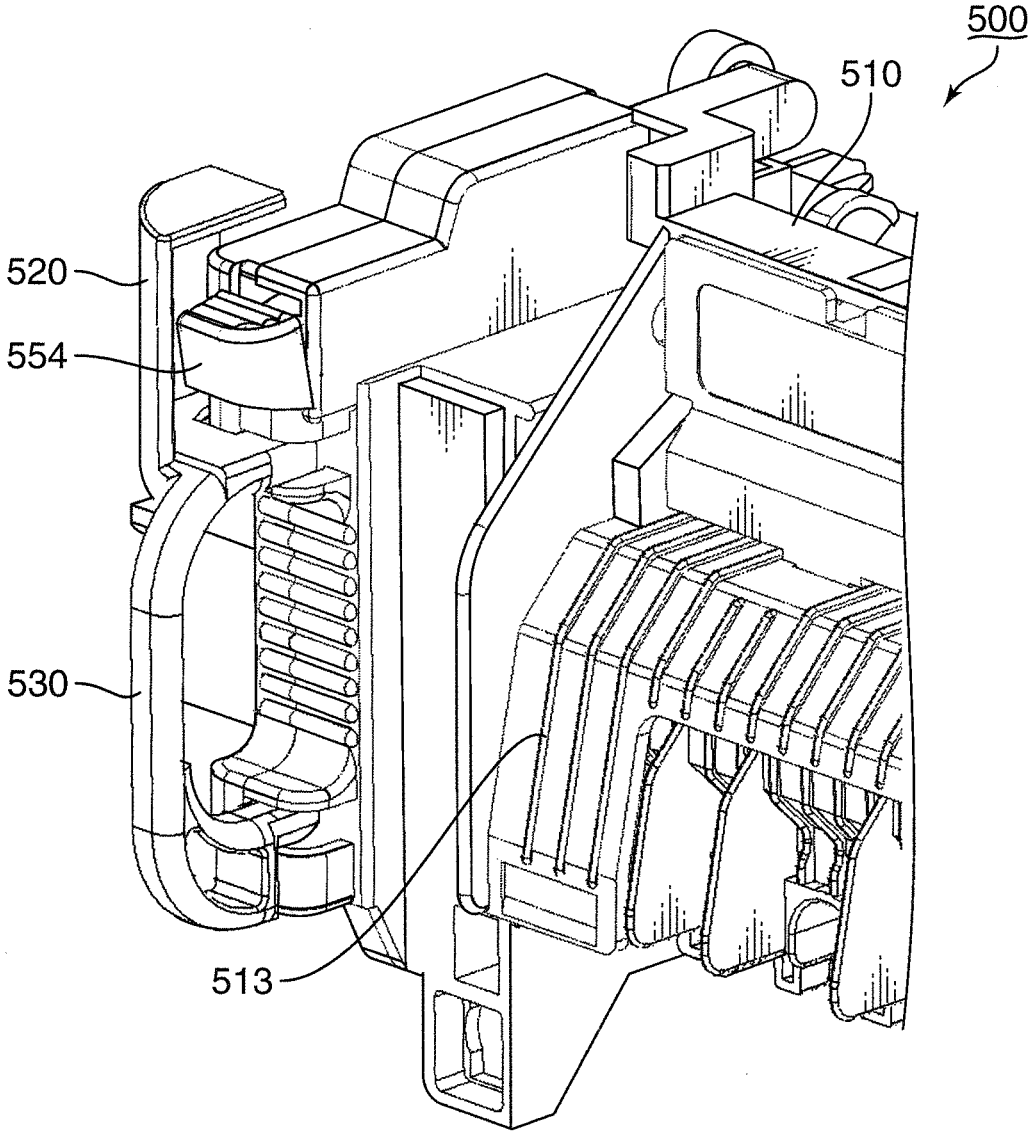
FIG. 5 is an enlarged view around the cover and the knob of the fixing device shown in FIG. 1.

FIG. 5 is an enlarged perspective view of the fixing device 500 and shows the structure around the cover 520 and knob 530. The fixing device 500 is further described with FIGS. 1, 3 and 5.

A user may grip and rotate the knob 530 toward the user. When the knob 530 is rotated by a rotation angle of substantially 90°, the knob 530 protrudes with respect to the front plate 513 of the fixing housing 510. Hence the user may easily grasp the knob 530. The cover 520 rotates integrally with the knob 530. Consequently the operation portion 554 protruding from the end surface of the accommodating portion 514 is exposed so as to be visible. In this embodiment, the position of the cover 520 for exposing the operation portion 554 so as to be visible is exemplified as a second position.

In this embodiment, the left cover 520 shown in FIG. 1 is exemplified as a first cover 520A. The right cover 520 is exemplified as a second cover 520B. The left knob 530 shown in FIG. 1 is exemplified as a first knob 530A. The right knob 530 is exemplified as a second knob 530B. The operation portion 554 covered and exposed by the first cover 520A is exemplified as a first operation portion. The operation portion 554 covered and exposed by the second cover 520B is exemplified as a second operation portion. Further, the immobilizing mechanism 550 comprising the first operation portion is exemplified as a first immobilizing mechanism. The immobilizing mechanism 550 comprising the second operation portion is exemplified as a second immobilizing mechanism.

As shown in FIG. 1, when the first cover 520A and the second cover 520B are in the first position, the first cover 520A and the second cover 520B invisibly cover the first operation portion and the second operation portion respectively, so that a user is likely to be unconscious of the operation portions. Hence the user is less likely to unnecessarily operate the operation portions 554. Further, the first cover 520A and the second cover 520B physically cover the first operation portion and the second operation portion, respectively, so that the user is appropriately less likely to unintentionally touch and operate the operation portions 554.

As described in the context of FIGS. 4 and 5, when the user grips and rotates the first knob 530A and the second knob 530B, the first cover 520A and the second cover 520B rotate toward the second position together with the first knob 530A and second knob 530B. Consequently the first operation portion and the second operation portion become visible to the user.

As shown in FIG. 3, torsion coil springs 532 used as a second biasing member are wound around the rotating shafts 531 of the first knob 530A and the second knob 530B, respectively. The torsion coil springs 532 bias the first knob 530A and the second knob 530B, respectively, so that the cover 520 moves toward the first position. Hence the user after movement of the first cover 520A and the second cover 520B to the second position, for example, while gripping the first knob 530A and the second knob 530B, has to press down the operation portion 554 with a thumb. Therefore the user is likely to operate the operation portion 554 without unnecessarily touching the fixing housing 510. Thus the structure according this embodiment facilitates the user to perform safer operation.

As described in the context of FIG. 3, the user may press the operation portion 554 downward to disengage the hook 552 from the engaging hole 610, so that the immobilized fixing housing 510 is released. Thereafter, the user may pull the first knob 530A and the second knob 530B toward the user to move the fixing housing 510 relative to the support plate 600.

Figure 6:
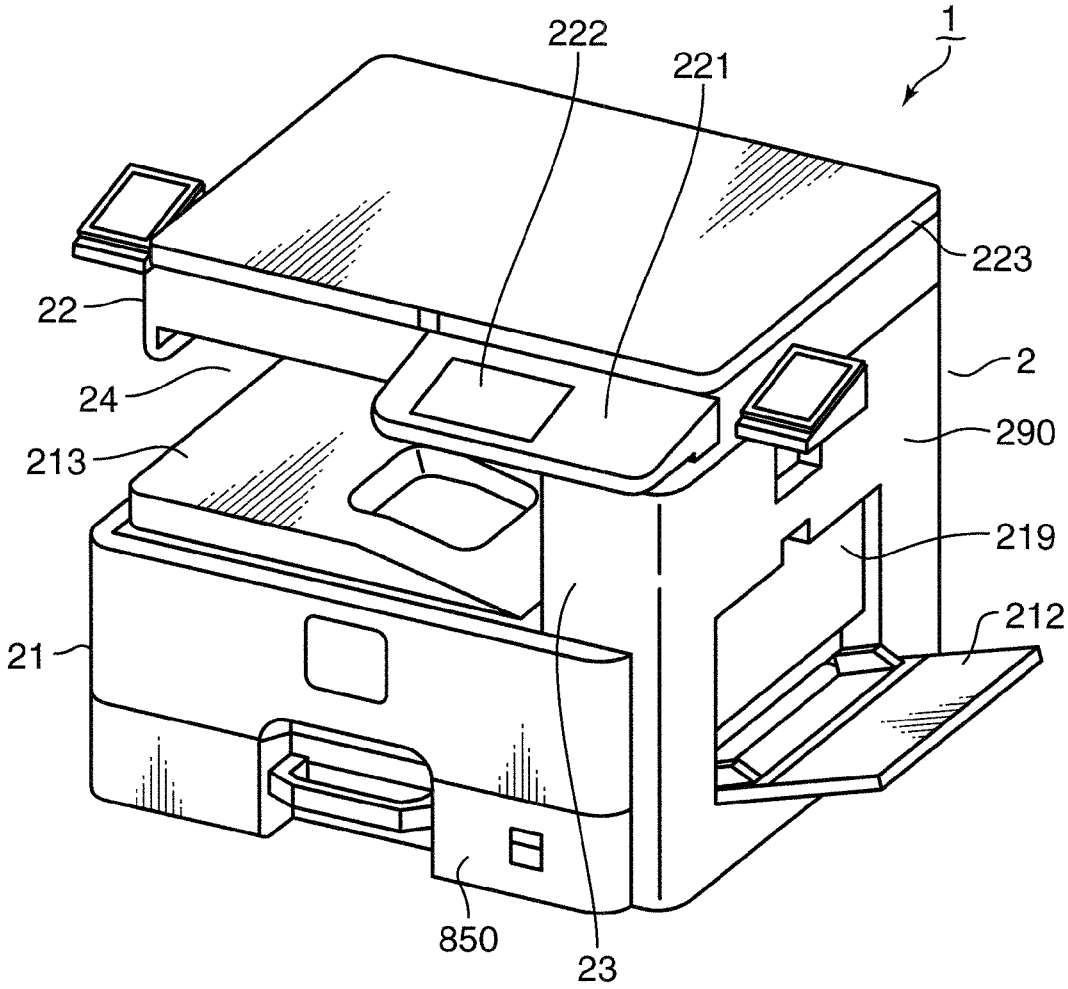
FIG. 6 is a schematic perspective view of an image forming apparatus incorporating the fixing device shown in FIG. 1.
Figure 7:
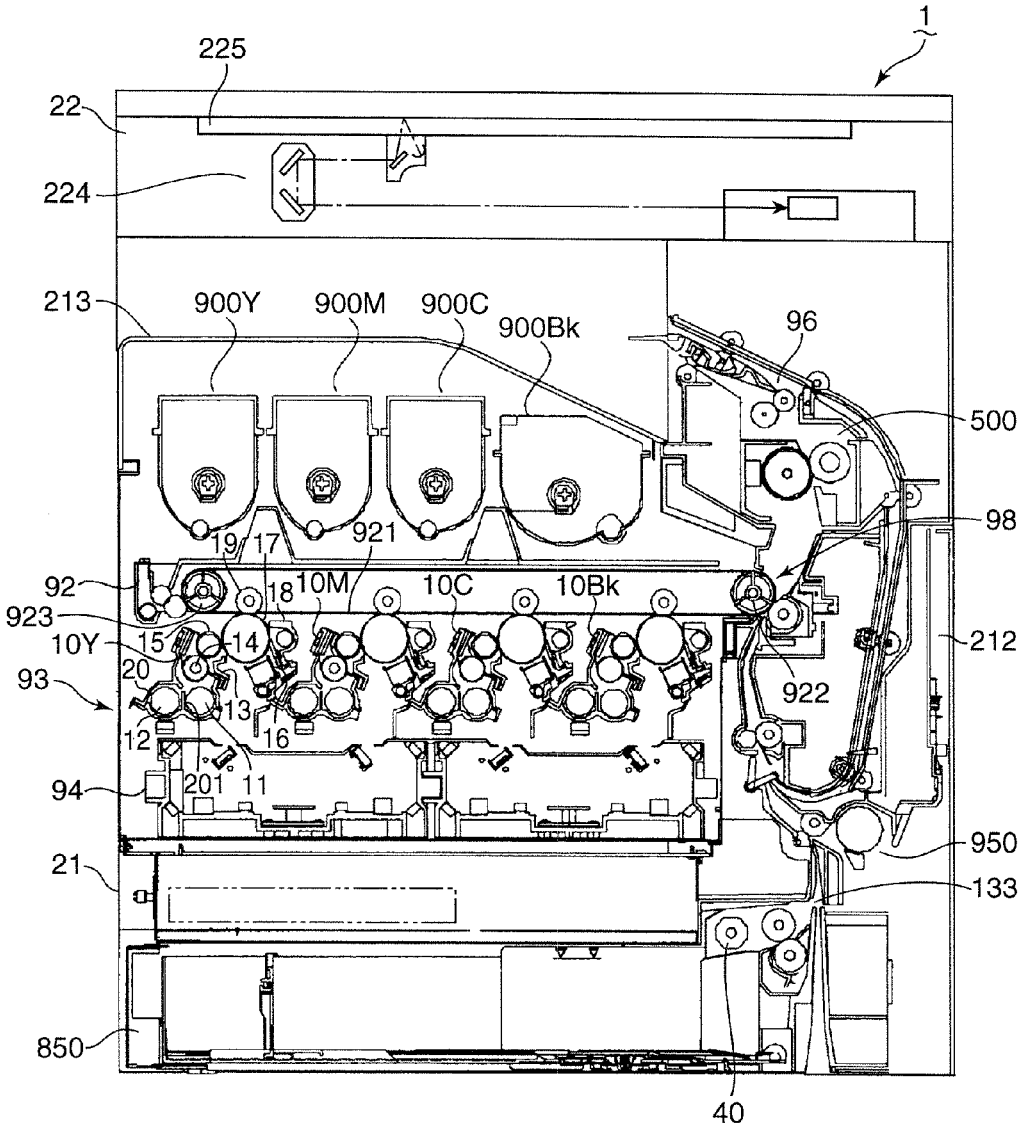
FIG. 7 is a schematic view showing an internal structure of the image forming apparatus shown in FIG. 6.

FIG. 6 is a perspective view of an image forming apparatus incorporating the fixing device 500 described in the context of FIGS. 1 to 5. FIG. 7 schematically shows an internal structure of the image forming apparatus shown in FIG. 6. The image forming apparatus shown in FIGS. 6 and 7 is a so-called internal discharge-type photocopier. Alternatively, the image forming apparatus may be a printer, a fax machine, a photocopier combining these functions, or another apparatus to form toner images on sheets.

The image forming apparatus 1 comprises a substantially rectangular parallelepiped housing 2. The housing 2 comprises a substantially rectangular parallelepiped lower housing 21, a substantially rectangular parallelepiped upper housing 22 disposed above the lower housing 21, and a joint housing 23 jointing the lower housing 21 with the upper housing 22. The joint housing 23 extends along a right edge and a rear edge of the housing 2. Sheets after printing process are discharged into a discharge space 24 surrounded by the lower housing 21, upper housing 22 and joint housing 23.

An operation panel 221 protruding in a front direction of the upper housing 22 comprises, for example, an LCD touch panel 222. The operation panel 221 is configured to receive input of information relating to image forming process. A user may input, for example, a number of sheets to be printed and printing density via the LCD touch panel 222. The upper housing 22 primarily accommodates equipment configured to read document images and electronic circuitries configured to control the entire image forming apparatus 1.

A pressing cover 223 disposed above the upper housing 22 is used to press a document. The vertically rotatable pressing cover 223 is mounted on the upper housing 22. The user may rotate the pressing cover 223 upward to place the document on the upper housing 22. Then, the user operates the operation panel 221 to cause an image of the document to be read out by the equipment disposed within the upper housing 22.

The lower housing 21 houses a cassette 850 configured to accommodate sheets. The cassette 850 may be withdrawn in a front direction from the lower housing 21. The sheets accommodated in the cassette 850 are subjected to the image forming process in the lower housing 21, and then are discharged to the discharge space 24 on the basis of instructions input by the user via the operation panel 221.

A tray 212 is rotatably mounted on a right surface of the lower housing 21. As shown in FIG. 6, when the tray 212 is deployed in a position where the tray 212 protrudes to the right of the lower housing 21, a user may place sheets on the tray 212. The sheets on the tray 212 are pulled into the lower housing 21, and then subjected to the image forming process, and finally discharged to the discharge space 24, on the basis of instructions input by the user via the operation panel 221. When the tray 212 is rotated upward, the tray 212 is accommodated within an accommodation space 219 formed in the right surface of the lower housing 21, so that the tray 212 closes a feed inlet from which the sheets is pulled into the lower housing 21.

The lower housing 21 accommodates various equipments to form images on sheets. Further, the joint housing 23 accommodates various equipments to discharge the sheets to the discharge space 24 after the image forming processing.

FIG. 7 schematically shows an internal structure of the image forming apparatus 1 shown in FIG. 6. The image forming apparatus 1 is further described with FIGS. 6 and 7.

The upper housing 22 accommodates a scanning mechanism 224. A user may use the scanning mechanism 224 to cause the image forming apparatus 1 to read out an image of a desired document. A contact glass 225 mounted on an upper surface of the upper housing is disposed above the scanning mechanism 224. The pressing cover 223 is used to press the document placed on the contact glass 225. When the user activates the image forming apparatus 1 via the operation panel 221, the scanning mechanism 224 scans and reads out the image of the document on the contact glass 225. Analog information of the image read out by the scanning mechanism 224 is converted into digital signals. The image forming apparatus 1 forms an image on a sheet based on the digital signals.

The lower housing 21 accommodates toner containers 900Y, 900M, 900C, 900Bk; an intermediate transfer unit 92; an image forming unit 93; an exposure unit 94; the fixing device 500; and a discharger 96.

The image forming unit 93 comprises the toner container 900Y for yellow (Y), the toner container 900M for magenta (M), the toner container 900C for cyan (C), and the toner container 900Bk for black (Bk). Below these containers are disposed developing devices 10Y, 10M, 10C, 10Bk, corresponding to YMCBk, respectively. The image forming unit 93 uses toner accommodated in these toner containers 900Y, 900M, 900C, 900Bk to form images on sheets.

The image forming unit 93 comprises photosensitive drums 17 (photosensitive bodies on which a latent image is formed by an electrophotographic method) which bear toner images of the corresponding colors, respectively. Photosensitive drums using an amorphous silicon (a-Si) based material may be employed as the photosensitive drums 17. Yellow toner, magenta toner, cyan toner and black toner are supplied to the photosensitive drums 17 from the toner containers 900Y, 900M, 900C, 900Bk, respectively.

A charger 16, a developing device 10 (10Y, 10M, 10C, 10Bk), a transfer unit (transfer roller) 19 and a cleaning device 18 are deployed around the photosensitive drum 17. The charger 16 uniformly charges a surface of the photosensitive drum 17. The exposure unit 94 exposes the surface of the charged photosensitive drum 17 to form an electrostatic latent image. The exposure unit irradiates with laser light based on the digital signals generated by the above-described scanning mechanism 224. The developing devices 10Y, 10M, 10C, 10Bk use toner supplied from the toner container 900Y, 900M, 900C or 900Bk, respectively to develop (visualize) the electrostatic latent images formed on the photosensitive drums 17. The transfer roller 19 and photosensitive drum 17 nip an intermediate transfer belt 921 to form a nip portion. The transfer roller 19 performs primary transfer of the toner image from the photosensitive drums 17 to the intermediate transfer belt 921. The cleaning device 18 cleans the circumferential surface of the photosensitive drum 17 after the toner image transfer.

The developing devices 10Y, 10M, 10C, 10Bk comprise a developer housing 20, respectively. The developer housing 20 accommodates two-component developer including a magnetic carrier and toner. Two rotatable stirring rollers 11 and 12 are arranged near a bottom of the developer housing 20. The stirring rollers 11 and 12 extend in parallel to each other.

A developer circulation path is formed on a bottom surface in the developing housings 20. The stirring rollers 11 and 12 are disposed in the circulation path. The developing housing 20 comprises a partition 201 standing between the stirring rollers 11 and 12. The partition 201 partially partitions the circulation paths. The circulation path surrounds the partition 201. The two-component developer is stirred and conveyed along the circulation path by the stirring rollers 11 and 12 while being charged.

The two-component developer on the stirring roller 11 is attracted and transported by an upper magnetic roller 14. The attracted two-component developer forms a magnetic brush (not shown) above the magnetic roller 14. A thickness of the magnetic brush layer is regulated by a doctor blade 13. A toner layer on a developing roller 15 is formed by potential difference between the magnetic roller 14 and the developing roller 15. The electrostatic latent image on the photosensitive drum 17 is developed by the toner layer.

The exposure unit 94 has optical equipments such as light sources, polygon mirrors, reflecting mirrors and deflecting mirrors. The exposure unit 94 irradiates the circumferential surfaces of the photosensitive drums 17, respectively, provided in the image forming unit 93 with light based on the image data to form electrostatic latent images.

The intermediate transfer unit 92 comprises the intermediate transfer belt 921, a driving roller 922 and an idle roller 923. Toner images from several photosensitive drums 17 are superimposed onto the intermediate transfer belt 921 (the primary transfer). The superimposed toner images are secondary-transferred onto a sheet fed from the cassette 850 or tray 212 (see FIG. 6) in a secondary transfer unit 98. The driving roller 922 and the idle roller 923, which works for running the intermediate transfer belt 921, are rotatably supported by the lower housing 21.

The fixing device 500 described in the context of FIGS. 1 to 5 performs a fixing process on a toner image after the secondary-transfer from the intermediate transfer unit 92 onto a sheet. The sheet with a color image after the fixing process is discharged to the discharger 96 formed in an upper portion (within the joint housing 23) of the fixing device 500.

The discharger 96 discharges sheets conveyed from the fixing device 500 onto an upper surface 213 of the lower housing 21, which is used as a discharge tray.

The cassette 850 accommodates a pile of stacked sheets onto which images are to be formed. The cassette 850 is detachably mounted into the lower housing 21, as described above. When a pickup roller 40 provided in the cassette 850 is driven, the uppermost sheet of the sheet pile in the cassette 850 is fed out to a feed conveyance path 133. Thereafter, the sheet is guided to the image forming unit 93. The pickup roller 40, the feed conveyance path 133 and roller elements disposed along the feed conveyance path 133 are exemplified as a conveyance portion configured to convey sheets to the image forming unit 93, which forms images on the sheets.

The tray 212 is disposed above the cassette 850. The tray 212 shown in FIG. 7 is at a closing position where the tray 212 closes the feed inlet. A lower end of the tray 212 is used as a rotation axis. The tray 212 may be rotated to the right to support a pile of stacked sheets. A feed assembly 950 is disposed near the lower end of the tray 212. The feed assembly 950 sends sheets placed on the tray 212 one after another to the image forming unit 93. Thereafter, images are formed on the sheets in the image forming unit 93.

Figure 8:
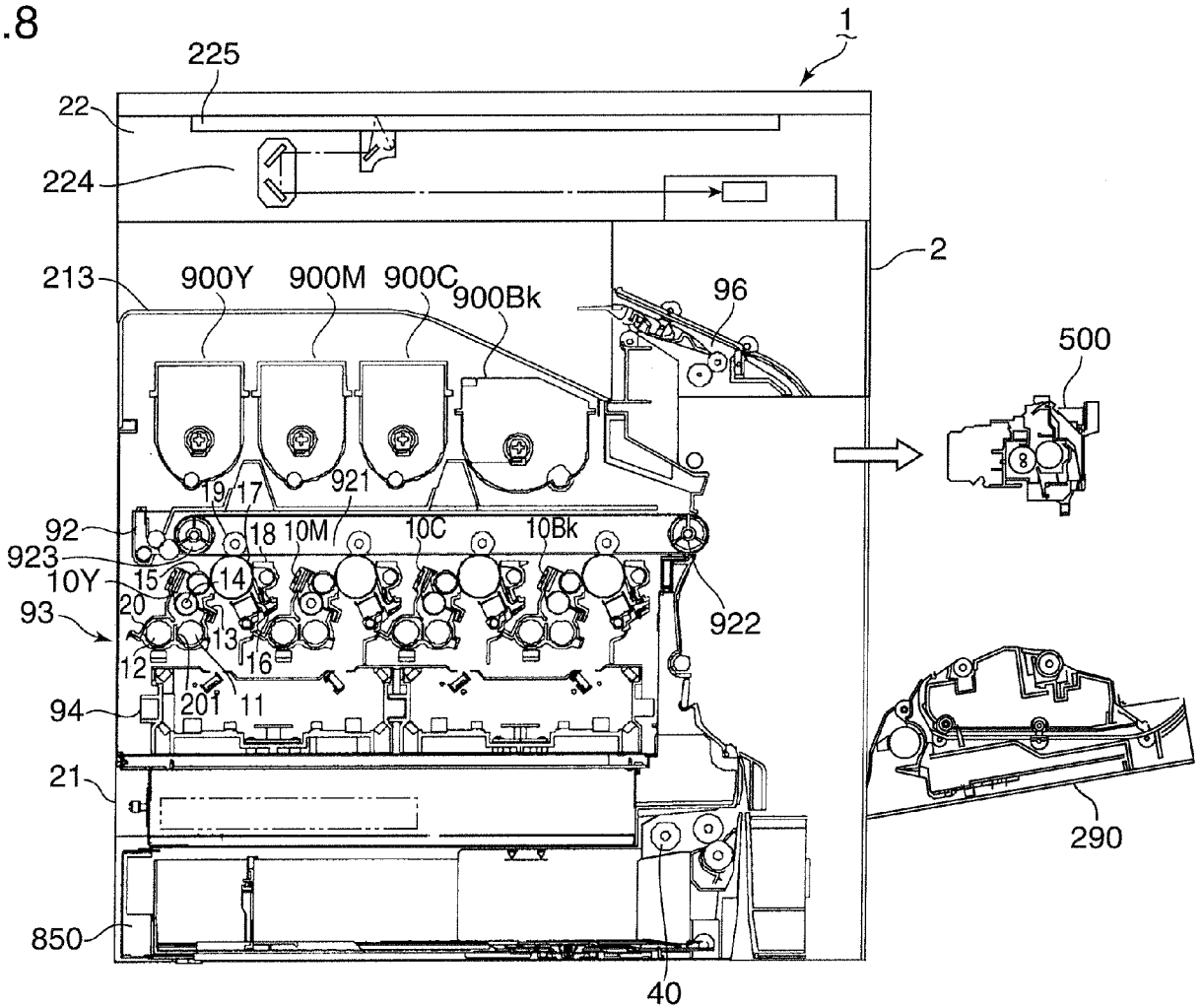
FIG. 8 shows removal of the fixing device from the image forming apparatus shown in FIG. 6.

FIG. 8 is a cross-sectional view schematically showing the fixing device 500 removed from the housing 2 of the image forming apparatus 1. Removal of the fixing device 500 from the housing is described with FIGS. 3 to 8.

When a side cover 290 of the housing 2 shown in FIG. 6 is rotated to the right, a user may operate the fixing device 500 accommodated in the housing 2. As described in the context of FIGS. 4 and 5, the user may rotate the knob 530 to expose the operation portion 554, so that the user is allowed to press down the operation portion 554. Consequently, as described in the context of FIG. 3, the fixing device 500 is disengaged from the support plate 600 formed in the housing 2. Thereafter the user still gripping the knob 530 may withdraw the fixing device 500 from the housing 2.

Conversely, the user may grip the knob 530 of the fixing device 500 to engage the support plate 600 in the housing 2 with the slit 511 of the fixing housing 510, so that the user is allowed to push the fixing device 500 into the housing 2. Consequently the hook 552 biased by the first biasing member engages with the engaging hole 610 formed in the support plate 600, so that the position of the fixing device 500 is fixed in the housing 2. Thereafter, when the user releases his hand from the knob 530, the cover 520 automatically returns to the first position by means of the torsion coil spring 532 used as the second biasing member. Eventually, the cover 520 covers the operation portion 554.

The principles of the above-described embodiment may be applied to various heating devices configured to perform a heating process. A principle of the above-described embodiment is to appropriately protect a user from heat energy generated from the heating device.

This application is based on Japanese Patent application serial No. 2010-014626 filed in Japan Patent Office on Jan. 26, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A processing assembly including a processor configured to execute a given process comprising:

a processing housing configured to support the processor;

an immobilizing mechanism configured to immobilize a position of the processing housing, and including an operation portion configured to release the immobilized processing housing;

a cover mounted on the processing housing so as to be rotatable between a first position where the operation portion is covered by the cover and a second position where the operation portion is exposed to be visible; and a knob rotatably mounted on the processing housing and configured to rotate integrally with the cover, wherein the knob lies along the processing housing when the cover is in the first position, and the knob protrudes from the processing housing when the cover is in the second position.

2. A processing assembly including a processor configured to execute a given process comprising:

a processing housing configured to support the processor;

an immobilizing mechanism configured to immobilize a position of the processing housing, and including a first operation portion and a second operation portion configured to release the immobilized processing housing;

a first cover mounted on the processing housing so as to be rotatable between a first position where the first operation portion is invisibly covered with the first cover and a second position where the first operation portion is exposed to be visible, and a second cover mounted on the processing housing to be rotatable between a first position where the second operation portion is invisibly covered with the second cover and a second position where the second operation portion is exposed to be visible;

a first knob configured to rotate integrally with the first cover, and a second knob configured to rotate integrally with the second cover; and wherein the immobilizing mechanism includes a first immobilizing mechanism configured to releases the immobilized processing housing through the first operation portion, and a second immobilizing mechanism configured to release the immobilized processing housing through the second operation portion.

3. The processing assembly according to claim 1, further comprising a second biasing member configured to bias the knob so that the cover moves toward the first position.

4. The processing assembly according to claim 1, wherein the cover is formed from an opaque material.

5. The processing assembly according to claim 1, wherein the given process includes a heating process.

6. A processing assembly including a processor configured to execute a given process comprising:

a processing housing configured to support the processor;

an immobilizing mechanism configured to immobilize a position of the processing housing, and including an operation portion configured to release the immobilized processing housing;

a cover mounted on the processing housing so as to be rotatable between a first position where the operation portion is covered by the cover and a second position where the operation portion is exposed to be visible; and a knob rotatably mounted on the processing housing and configured to rotate integrally with the cover, wherein the immobilizing mechanism includes:

an arm including a base end used as the operation portion and a tip end formed with a hook configured to engage with an engaging hole formed in a support portion configured to support the processing housing; and a first biasing member configured to bias the arm so that the hook engages with the engaging hole, and the arm mounted on the processing housing is allowed to rotate about a rotation axis between the base end and the tip end.

7. A fixing device including a fixing portion configured to fuse and fix toner to a sheet comprising:

a fixing housing configured to support the fixing portion;

an immobilizing mechanism configured to immobilize a position of the fixing housing, and including an operation portion configured to release the immobilized fixing housing;

a cover mounted on the fixing housing so as to be rotatable between a first position where the operation portion is covered by the cover and a second position where the operation portion is exposed to be visible; and a knob rotatably mounted on the fixing housing and configured to rotate integrally with the cover, wherein the knob lies along the processing housing when the cover is in the first position, and the knob protrudes from the processing housing when the cover is in the second position.

8. An image forming apparatus for forming an image on a sheet comprising:

a housing;

an image forming unit configured to form the image on the sheet with toner;

a fixing housing configured to support a fixing portion for fusing and fixing the toner on the sheet;

an immobilizing mechanism configured to immobilize a position of the fixing housing in the housing, and including an operation portion configured to release the immobilized fixing housing;

a cover mounted on the fixing housing so as to be rotatable between a first position where the operation portion is covered by the cover and a second position where the operation portion is exposed to be visible; and a knob rotatably mounted on the fixing housing and configured to rotate integrally with the cover, wherein the knob lies along the processing housing when the cover is in the first position, and the knob protrudes from the processing housing when the cover is in the second position.

* * * * *